US005318296A

United States Patent [19]

Adams et al.

[11] Patent Number: 5,318,296

[45] Date of Patent: Jun. 7, 1994

[54] MATCHED SETS FOR GOLF CLUBS HAVING MAXIMUM EFFECTIVE MOMENT OF INERTIA

[75] Inventors: Byron H. Adams, Dallas, Tex.; Faris W. McMullin, Boise, Id.

[73] Assignee: Adams Golf Inc., Richardson, Tex.

[21] Appl. No.: 974,707

[22] Filed: Nov. 12, 1992

[51] Int. Cl.[5] ..... A63B 53/00

[52] U.S. Cl. ..... 273/77 A; 73/65.03; 273/80 A

[58] Field of Search ..... 273/77 R, 77 A, 80 A, 273/80 R, 80 C, 167 G; 73/65

[56] References Cited

U.S. PATENT DOCUMENTS

| | | | |
|---|---|---|---|
| 3,473,370 | 10/1969 | Marciniak | 73/65 |
| 3,698,239 | 10/1972 | Everett, III | 73/65 |
| 3,703,824 | 11/1972 | Osborne et al. | 73/65 |
| 4,203,598 | 5/1980 | Stuff et al. | 273/80 A |
| 4,212,193 | 7/1980 | Turley | 73/65 |
| 4,240,631 | 12/1980 | MacDougall | 273/77 A |
| 4,420,156 | 12/1983 | Campau | 273/77 A |
| 4,674,324 | 6/1987 | Benoit | 273/77 A |
| 4,840,380 | 6/1989 | Kajita et al. | 273/77 A |
| 4,971,321 | 11/1990 | Davis | 273/77 A |
| 5,094,101 | 3/1992 | Chastonay | 273/77 A |

*Primary Examiner*—Vincent Millin
*Assistant Examiner*—Steven B. Wong
*Attorney, Agent, or Firm*—Aquilino & Welsh

[57] ABSTRACT

A dynamically matched set of golf clubs having a variable optimum moment of inertia for each club in the set wherein each club has a moment of inertia proportional to the lie angle of the club and the optimum value of the moment of inertia is determined using precise mathematical formulas and calculations.

13 Claims, 1 Drawing Sheet

MATCHED SETS FOR GOLF CLUBS HAVING MAXIMUM EFFECTIVE MOMENT OF INERTIA

BACKGROUND OF THE INVENTION

The present invention relates to a set of golf clubs, and in particular, to a set of golf clubs having a maximum effective moment of inertia.

The playing of the game of golf and the equipment used therewith are controlled by the United States Golf Association rules of golf, which are designed to preserve the essence of the game by not allowing equipment producing improvements outside the skill level of the player. For this reason, and given the fact that the equipment works well, golf equipment has stayed generally constant over time, the exception being the progression from wooden golf clubs to more technically advanced metals, graphites, and other plastics, which are currently in use today.

Golf is played with a set of golf clubs, each individual club being designed to hit certain types of golf shots and/or to hit the golf ball certain distances depending upon the player's position and distance from the target, the hole. Within these parameters, there are a wide variety of numbers and types of golf clubs which comprise a set. Normally, a set of clubs totals fourteen, the maximum number allowed when playing a game in accordance with United States Golf Association rules. Such a set includes three to five woods, a putter and the remainder being irons. Individual golfers often vary the makeup of each set of golf clubs. For example, a set can be made of only one or two wood type clubs, the rest of the set being distributed among irons and a putter. The distribution of the various clubs generally provide a golfer with a series of different lengths, weights and lofts of club heads, which enable the golfer to hit shots of varying distance and trajectory, depending upon the particular golf shot required when playing a game of golf on a golf course. Traditionally, wooden type golf clubs are used to hit the ball greater distances, whereas the iron type golf clubs hit shorter and more controlled golf shots. Most golf clubs used today are matched in accordance with swing weight, and in an optimum set, shaft frequency. Swing weight process is a system of static measurements based on a linear function of the shaft, grip and head in relationship to each other, using a swinging weight matching scale as described in the U.S. Pat. No. to Adams (1,953,916). The clubs of such a conventional matched set balance at the same setting on the scale. The scale reading is then used to designate the swing weight characteristics of the set to provide a statically balanced golf club. This process of swing weight measurement gained wide acceptance because most of the shafts used were relatively of the same dead weight. However, with modern technology. There are great weight differences in shafts due to new materials available, and the idea of swing weight is less applicable because this traditional way of matching golf clubs creates a set which does not swing the same. Conventional golf clubs are statically matched rather than being dynamically matched, so that the clubs within the set are not matched when they are swung to hit a golf ball.

The concept of dynamically matching a set of golf clubs in accordance with the moment of inertia has been addressed in the prior art. For example, the U.S. Pat. No. to Marciniak (3,473,370) discloses a method of producing a dynamically matched set of golf clubs having the same moment of inertia by selecting a club of a desired swinging and playing action and determining its moment of inertia. This is accomplished using a torsional pendulum and measuring the moment of inertia with respect to the center of gravity. A set is made by selecting other clubs and applying heads of different weights until measurement with the torsional pendulum indicates that the same moment of inertia has been obtained. The data is plotted on a graph, which then can be read for the required head weights for the complete set.

The U.S. Pat. No. to Everett, III (3,698,239) relates to a dynamically matched set of golf clubs also having identical moments of inertia with respect to a common swinging axis. Using a selected club, the moment of inertia is determined by calculation from length and weight parameters. The head weights required for dynamically matching other sets in the club are matched to the favorite club.

The U.S. Pat. No. to Osborne et al. (3,703,824) relates to an apparatus for comparing moments of inertia of golf clubs about a given axis using a balance beam on a fulcrum, a means for supporting a club and a weight adapted to slide along the balance beam for counterbalancing the shaft and head, and a second weight on the beam between the fulcrum and the head whereby the two counterweights move over separate scales. The first scale is positioned on part of the beam and calibrated in units of moment of inertia, and the second scale positioned on another part of the beam, calibrated in length of the golf club. To make a set of clubs, each club is chosen such that its moment of inertia about a specific axis does not vary by more than a preset amount.

The U.S. Pat. No. to Suganuma (4,900,025) relates to a dynamically matched set of golf clubs using a uniform grip weight, shafts having different lengths and different shaft deflection characteristics. When a given torque is applied to each club about the same reference point, moments of force at the head and sides of the club are standardized with reference to a central portion between the hands of the player who holds a club during a swing about a rotating axis. When natural frequencies of the club head end are set and measured with reference to the central portion as a support end, the natural frequency of arbitrary clubs are fixed in accordance with a predetermined formula.

The U.S. Pat. No. to Turley (4,212,193) is directed to an apparatus and method for determining the moment of inertia of golf clubs using a low-cost electronic means to measure periods of oscillation and to compute and display the moment of inertia thereby. The patent teaches that clubs are matched by adding weight or adjusting length in order that the moment of inertia of each golf club be matched.

SUMMARY OF THE INVENTION

The present invention relates to a set of golf clubs wherein the clubs in the set are more consistent to swing and produce greater distance and accuracy by dynamically matching each club in the set to others. The clubs are matched using a precise moment of inertia formula whereby each club in the set has a variable but matched moment of inertia value in accordance with the length and lie angle of each club. Therefore, the present invention provides an improvement over swing weighted matched golf clubs by calculating the effective moment of inertia of each club and balancing the set in accordance with optimum predetermined characteristics.

A quintessential book on golf equipment, *Search for the Perfect Swing*, was published in 1968 by Alastair Cochran and John Stobbs. Its exhaustive research remains today as a foundation for many generally held golf club design parameters. The book discusses the relevance of the moment of inertia of golf clubs, and its relevance to the striking of a golf ball. This moment of inertia principle is the cornerstone underlying the present invention.

The present invention is particularly applicable to modern lightweight shafts, such as graphites and graphite composites, as well as lightweight steel. Using the VMI formula, the golf clubs of the present invention have head weights significantly heavier than the head weights of conventional golf clubs, resulting in greatly improved playing characteristics. In accordance with the teachings of the present invention, each individual golf club of the set is made with a maximum effective moment of inertia which varies from club to club in accordance with the length and lie angle of each club. Initially, a golf club is selected having a moment of inertia which is used as a standard or control to which the other clubs are matched, using a precise moment of inertia formula and mathematical calculations based on the lie angle of the particular club being made. The standards are based on golf clubs which have been used for numbers of years and have been successfully used to play the game of golf by a wide variety of players to hit inestimable numbers of golf shots. Using the formula, the maximum effective moment of inertia based on traditional golf clubs is provided not only for individual golf clubs, but for each club within a complete set.

The maximum effective moment of inertia for each golf club in a set varies in accordance with the lie angle of each club and this optimum moment of inertia may be calculated based on this lie angle using the formula of the present invention. In a normal set of golf clubs, the lie angle increases with the shorter clubs and the moment of inertia decreases. Using the formulas, the optimum amount of inertia may be obtained for any golf club even when variations in the standard lie angle are used, for example, when custom golf clubs are made for taller or shorter players.

Various categories of clubs may be made in accordance with the present invention to accommodate players of different body types and strengths, and different playing ability levels, for example; tour players, low handicap amateur players, medium handicap players, high handicap players, and players with less limited abilities, including some women, children and elderly golfers. A driver, or a number one wood, normally is used as the standard in each category, although it will be appreciated that any club in a set could be used as a standard with no effective change in the development of the set in accordance with the present invention.

In addition to providing a calculated moment of inertia for each club in a set, the club is balanced by providing a back weight adjacent the butt or grip end of the golf club to create a balance point typical of those found in golf clubs which have been recognized as classics or standards in the field. The lighter weight shaft used to make current conventional golf clubs allows a heavier head weight in keeping with the formula parameters. The back weight is used to counterbalance the heavier head weight, permitting the shaft to have a balance point the same as the control club, thereby permitting the clubs to feel and swing essentially the same within a set, while providing increased mass to hit a golf ball for a given amount of force created during a golf swing.

Among the objects of the present invention is to provide a set of golf clubs that is dynamically balanced and easier to swing to produce longer, more consistent and accurate golf shots.

Another object of the present invention is to provide a set of dynamically balanced and matched golf clubs which represents an improvement over statically swing weighted balanced golf clubs.

Another object of the present invention is to provide a set of golf clubs which eliminates equipment variables and improves muscle memory.

Still another object of the present invention is to provide a matched set of golf clubs which does not require the golfer to consciously adjust his swing for each different individual golf club.

Yet another object of the present invention is to provide a set of golf clubs permitting a player to use technically improved materials in the golf club construction without having to make major swing adjustments when playing the clubs.

Another object of the present invention is to provide a set of golf clubs having an optimum moment of inertia determined for each individual golf club in the set.

Other objects will become apparent with reference to the following description of the preferred embodiments of the invention.

It is to be understood that the foregoing general description and the following detailed description are exemplary and explanatory only and are not restrictive of the invention, as claimed.

The accompanying drawings, which are incorporated in and constitute a part of this specification, illustrate the invention and, together with the description, serve to explain the principles of the invention.

DESCRIPTION OF THE PREFERRED EMBODIMENTS

Figure 1:
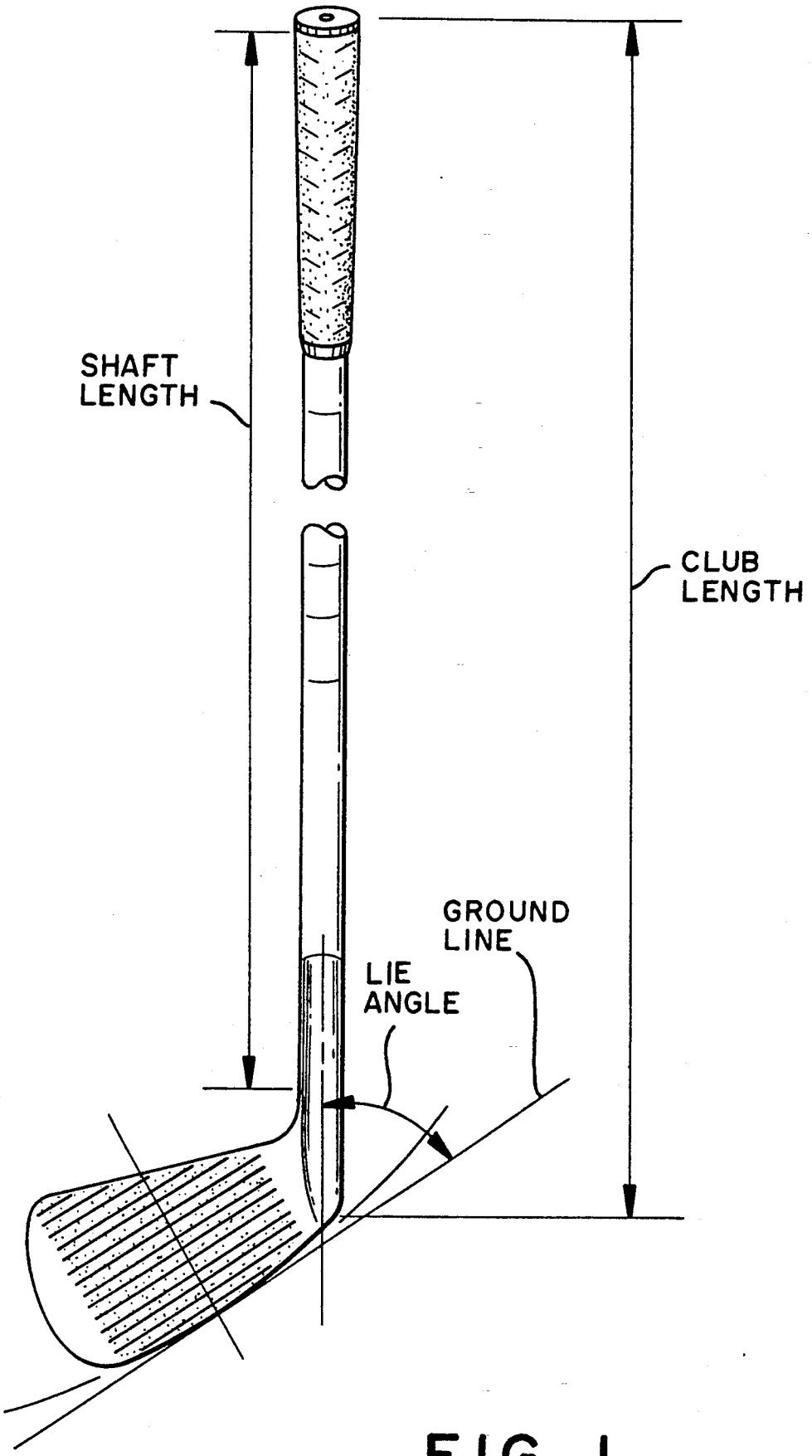
FIG. 1 is a schematic view of a golf club using the principles of the present invention.

The present invention relates to a set of golf clubs and a method of making a set of golf clubs in accordance with a mathematical formula for determining a maximum effective moment of inertia for each club in the set. A typical golf club is shown in FIG. 1 having an overall club length, shaft length and lie angle. A moment of inertia value for a control club in the set is chosen based on values found in traditional, or classic, golf clubs that have been used successfully over the years. The playing ability of the individual golfer for whom the club is made is also considered, such that a maximum effective moment of inertia is determined for a particular player based on these traditional clubs. Once the standard moment of inertia value for the control club is established, the moment of inertia for each individual golf club in the set, which varies from club to club, primarily in accordance with club length, shaft length, head weight, shaft weight and lie angle, is calculated in order that each club in the set be matched to the control golf club. Using the concepts of the present invention, the clubs made in accordance with the present invention have heavier head weights and lighter shaft weights. The clubs are subsequently balanced by adding weight at the grip end to achieve an improved, dynamically balanced golf club.

With the present invention, the moment of inertia of each golf club within a set of clubs is proportional to the control club. The proportionality is determined by the respective lie angle of each of the clubs, wherein clubs in the set having a greater lie angle have a lesser moment of inertia value than clubs in the set having a lesser lie angle. For example, a driver with a lesser lie angle would have a greater moment of inertia than one of the shorter clubs with a greater lie angle, such as an iron.

The moment of inertia, MI, of the control golf club is calculated by the following formula:

$$MI = (W_1)(L_1)^2 + \frac{(W_2)(L_2)^2}{3}$$

wherein W1 is club head weight, L1 is club length, W2 is shaft weight and L2 is shaft length.

Once the moment of inertia value of the control club is selected based upon the particular playing ability of a golfer who used the club, the only unknown value in the moment of inertia formula is head weight, since the other parameters, which vary from player to player, including club length, shaft length and shaft weight, are fixed. Using the formula, the club head weight, W1, is calculated. The golf club made in accordance with the calculated head weight value will have the maximum effective moment of inertia for the particular player. When using technically superior lighter weight golf shafts which are currently available, it is possible to obtain the precise desired or standard moment of inertia by simply adjusting the head weight of the golf club. It can be seen that lighter weight shafts require heavier head weights, and conversely, a heavier shaft would require a lighter head weight to achieve the same moment of inertia value.

The next step in creating a golf club is to consider its overall balance. In order to make the golf club playable so that, for example, the head weight does not feel disproportionately heavy, the club must be balanced. When using light shafts and heavy head weights, it has been found back weight at the grip or butt end of the golf club is necessary to produce a playable golf club. When establishing a moment of inertia for a particular golf club, technically both the grip weight and/or any back weight should be considered in the moment of inertia formula, however, these weights are relatively insignificant with respect to the weight of the shaft and head. Therefore, for the purposes of the present invention, the grip and back weight are ignored, since there is little effective change when calculating the head weight when these back weights are included in the moment of inertia formula. However, back weight determines the exact balance point once the overall head weight of the club head is determined, as described hereinbelow.

The balance point is determined by the overall length of the golf club, the weight of the club head, and the weight of the shaft and grip weight as well as any additional back weight which may be used. For a particular set of clubs, the balance point ranges from a minimum of seven inches from the bottom of the club for the wedges up to approximately 13 inches for a driver. The balance point of a golf club being made must match the balance point of the control club in order to provide the same playing characteristics. Therefore, assuming the length of the club being made and the control club is the same, the balance point would be the same and it is only necessary to add back weight to the butt end of the golf club until this balance point is achieved. However, if the length of the club being made is different from the length of the control club, in order to determine the exact balance point, BP, for this particular golf club, the following balance point formula is used:

$$BP = \frac{L^2}{Lc^2}(BPc)$$

wherein Lc is the length of the control club, L is the overall length of the club being made, and BPc is the balance point of the control club. To achieve this exact balance point calculated by the formula, back weight is added to the butt end of the golf club until the balance point is achieved as measured using a number of known methods. In making golf clubs in accordance with the present invention, it has been found that the back weight will vary in accordance with the head weight of the golf club and the particular type of golf club being made.

With the present invention, clubs in the set which differ from the control club require an adjustment in the value of the moment of inertia in accordance with the lie angle of each club. Using the lie angle of a control club as a standard, the moment of inertia (MI) for a golf club being made or designed may be found in accordance with the following formula:

$$MI = \frac{1 + \cos\Theta}{1 + \cos\Theta_c} \times MI_c$$

wherein $\Theta_c$ equals the control club lie angle, usually the lie angle of a driver, and $\Theta$ is the lie angle of the club being designed and $MI_c$ is the moment of inertia of the control club.

The moment of inertia of any given golf club in a set varies in accordance with the lie angle of the particular individual club. In other words, there is a direct ratio between the moment of inertia and the lie angle of the club. Using the lie angle formula, it can be seen that the moment of inertia decreases from the longer clubs to the shorter clubs, primarily due to the increase in the lie angle in the golf club. For example, the moment of inertia of a driver in accordance with the present invention is higher than the moment of inertia of a five iron, and a five iron, in turn, has a higher moment of inertia than a wedge.

The set of golf clubs in accordance with the present invention is specifically designed to be used with lightweight shafts in the range of approximately 60 to 110 grams, whereas the moment of inertia formula is applicable for shafts with heavier weights, the playability of the golf club is greatly enhanced when using a lightweight shaft. The lightweight shafts combined with a heavier head weights and back weights to balance the clubs produces a set of golf clubs having playing characteristics which are greatly improved over the conventional or standard clubs.

It will be appreciated that variations may be made from the teachings of the present application, which are exemplary only, within the scope and spirit of the invention as defined by the following claims.

We claim:

1. A dynamically matched set of golf clubs, each individual golf club in the set including a club head, a shaft and a grip on a butt end of the club; one individual golf club in the set having a selected moment of inertia value whereby the one individual golf club serves as a control club for remaining golf clubs in the set; each of the other individual golf clubs in the set having a moment of inertia different than and proportional to the moment of inertia of the control club, the proportionality being determined by the respective lie angle of each of the other individual golf clubs and the control club.

2. The set of golf clubs of claim 1 wherein clubs in the set having a lesser lie angle have a greater moment of inertia than clubs in the set having a greater lie angle.

3. The golf club set of claim wherein the moment of inertia, MIc, of the control club is defined by the following formula:

$$MIc = (W1_1)(L_1)^2 + \frac{(W_2)(L_2)^2}{3}$$

wherein W1 is club head weight, L1 is club length, W2 is shaft weight and L2 is shaft length.

4. The golf club set of claim 3 being further defined by each of the golf clubs in the set having a back weight at said butt end of the club to counterbalance the club head; said control club having a selected balance point BPc and wherein the balance point BP on each of the other individual golf clubs is calculated in accordance with the following formula:

$$BP = \frac{L^2}{Lc^2}(BPc)$$

wherein Lc is the length of the control club, L is the length of one of said individual golf clubs, and BPc is the balance point of the control club.

5. The golf club set of claim 1 wherein the moment of inertia, MI, of each of the other individual golf clubs in the set is determined in accordance with the following formula:

$$MI = \frac{1 + \cos\Theta}{1 + \cos\Theta_c} \times MI_c$$

wherein $MI_c$ is the moment of inertia of the control club, $\Theta$ is the lie angle of one of said other individual golf clubs and $\Theta_c$ is the control club lie angle.

6. The golf club set of claim 1 wherein a balance point, BP, for one of said individual golf clubs in the set is determined in accordance with the following formula:

$$BP = \frac{L^2}{Lc^2}(BPc)$$

wherein Lc is the length of a control club, L is the length of said one of said individual golf clubs, and BPc is the balance point of the control club.

7. A method of producing a dynamically matched set of golf clubs wherein each golf club in the set has a moment of inertia matched to the others and proportional to the lie angle of each golf club, comprising the steps of:

selecting an individual golf club in the set having a predetermined moment of inertia value and using the selected club as a control club to which the remaining golf clubs in the set are matched;

calculating the moment of inertia, MIc, for said control club in accordance with a moment of inertia formula; and, calculating the moment of inertia, MI, for each of the remaining clubs in the set in accordance with a formula based on the differences in the respective lie angles of each of the golf clubs.

8. The method of producing a dynamically matched set of golf clubs of claim 7 wherein the moment of inertia, MIc, of the control club is calculated in accordance with the following formula:

$$MIc = (W_1)(L_1)^2 + \frac{(W_2)(L_2)^2}{3}$$

wherein W1 is club head weight, L1 is club length, W2 is shaft weight and L2 is shaft length.

9. The method of claim 8 wherein the step of calculating the moment of inertia, MI, of the other clubs is based on the differences in the lie angle between the individual clubs using the following formula:

$$MI = \frac{1 + \cos\Theta}{1 + \cos\Theta_c} \times MI_c$$

wherein $MI_c$ is the moment of inertia of the control club, $\Theta$ is the club lie angle of one of said individual clubs, and $\Theta_c$ is the control club lie angle.

10. The method of claim 9 further including the steps of calculating the balance point, BP, for an individual club in the set in accordance with the following formula:

$$BP = \frac{L^2}{Lc^2}(BPc)$$

wherein Lc is the length of the control club, L is the length of said individual club, and BPc is the balance point of the control club; and, balancing said individual golf club in the set to the calculated balance point by providing a counterweight at the butt end of each golf club.

11. A dynamically matched set of golf clubs, each individual golf club in the set including a club head, a shaft and a grip on a butt end of the club;

one of the individual golf clubs in the set having a selected moment of inertia value whereby the one individual club serves as a control club for remaining golf clubs in the set; the moment of inertia, MIc, of the control club being defined by the following formula:

$$MIc = (W1I)(L_1)^2 + \frac{(W_2)(L_2)^2}{3}$$

wherein W1 is club head weight, L1 is club length, W2 is shaft weight and L2 is shaft length;

each one of the other individual golf clubs in the set having a moment of inertia different than and proportional to the moment of inertia of the control club, the proportionality being determined by the respective lie angle of each one of the other individual golf clubs wherein the moment of inertia, MI, of each one of the other individual clubs in the set is determined in accordance with the following formula:

$$MI = \frac{1 + \cos \Theta}{1 + \cos \Theta_c} \times MI_c$$

wherein $MI_c$ is the moment of inertia of the control club, $\Theta$ is the lie angle of one of said individual golf clubs and $\Theta_c$ is the control club lie angle.

12. The golf club set of claim 11 being further defined by a back weight on the butt end of the club to counterbalance the club head, said golf club having a balance point between the club head and said butt end of the club.

13. The golf club set of claim 12 wherein the control club has a preselected balance point and each one of the other individual golf clubs in the set has a balance point, BP, calculated in accordance with the following formula:

$$BP = \frac{L^2}{Lc^2} (BPc)$$

wherein Lc is the length of a control club, L is the length of said individual club being made, and BPc is the balance point of the control club.

* * * * *